US009225053B2

(12) United States Patent
Hung et al.

(10) Patent No.: US 9,225,053 B2
(45) Date of Patent: Dec. 29, 2015

(54) ANTENNA AND ELECTRONIC DEVICE HAVING THE SAME

(75) Inventors: Tzu-Chieh Hung, Taichung (TW); Saou-Wen Su, Keelung (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 565 days.

(21) Appl. No.: 13/184,042

(22) Filed: Jul. 15, 2011

(65) Prior Publication Data

US 2012/0293376 A1 Nov. 22, 2012

(30) Foreign Application Priority Data

May 19, 2011 (CN) ..... 2011 1 0129520

(51) Int. Cl.

| | |
|---|---|
| ***H01Q 1/52*** | (2006.01) |
| ***H01Q 1/24*** | (2006.01) |
| ***H01Q 1/22*** | (2006.01) |
| ***H01Q 9/42*** | (2006.01) |
| ***H01Q 21/28*** | (2006.01) |
| ***H01Q 5/371*** | (2015.01) |

(52) U.S. Cl.

CPC ..... *H01Q 1/2266* (2013.01); *H01Q 5/371* (2015.01); *H01Q 9/42* (2013.01); *H01Q 21/28* (2013.01)

(58) Field of Classification Search

CPC ..... H01Q 5/371; H01Q 9/42

USPC ..... 343/841

See application file for complete search history.

(56) References Cited

U.S. PATENT DOCUMENTS

| | | | | |
|---|---|---|---|---|
| 6,677,915 | B1 * | 1/2004 | Yablonovitch et al. | 343/841 |
| 7,589,680 | B2 * | 9/2009 | Tsai et al. | 343/702 |
| 2008/0120668 | A1 * | 5/2008 | Yau | 725/110 |
| 2008/0316111 | A1 * | 12/2008 | Aoyama et al. | 343/700 MS |
| 2009/0128439 | A1 * | 5/2009 | Su et al. | 343/795 |
| 2009/0231203 | A1 * | 9/2009 | Ficker et al. | 343/700 MS |
| 2010/0156738 | A1 * | 6/2010 | Pu et al. | 343/841 |

FOREIGN PATENT DOCUMENTS

| | | | |
|---|---|---|---|
| CN | 101431179 | A | 5/2009 |
| CN | 101499562 | A | 8/2009 |
| CN | 101677146 | A | 3/2010 |
| TW | 200719518 | A | 5/2007 |

OTHER PUBLICATIONS

X. Wang, W. Chen and Z. Feng "Multiband antenna with parastic branches for laptop applications" Electronics Letters Sep. 13, 2007 vol. 43 No. 19, Figs 1a-c, col. 1, Line 25~27 from the button.

* cited by examiner

*Primary Examiner* — Hoang V Nguyen
*Assistant Examiner* — Michael Bouizza
(74) *Attorney, Agent, or Firm* — Li & Cai Intellectual Property (USA) Office

(57) ABSTRACT

A multi-band antenna includes a grounding portion, a main radiating portion, and a shielding wall. The main radiating portion includes a first radiating portion having a first feed end and a second radiating portion having a second feed end. The first and second radiating portions are structurally symmetrical. The main radiating portion and the shielding wall are arranged on opposite sides of the grounding portion.

13 Claims, 17 Drawing Sheets

ANTENNA AND ELECTRONIC DEVICE HAVING THE SAME

BACKGROUND OF THE INVENTION

1. Field of the Invention

The instant disclosure relates to an antenna structure; more particularly, to a dual-band antenna and an electronic device having the same.

2. Description of Related Art

With the development in mobile communication and wireless interne, the application field of wireless communication is continuously expanding. Correspondingly, the demands for dual-band or multi-band antennas are increasing. Conventionally, multi-band antennas often use slots or holes to excite another resonance mode to operate on several bands, such as the Bluetooth and 802.11a/b/g wireless standards. However, these types of antennas tend to be physically larger and occupy more space.

Conventional antennas are mostly designed under the concept of planar inverted-F antenna, or PIFA. These antennas are normally used on laptop computers and handheld devices. In general, the antennas use mini coaxial lines at the feed ends of the antennas to feed antenna signals. However, the feed direction of the conventional antenna is fixed, which can not be relocated arbitrarily to match with the system requirement. In such case, a rerouted antenna structure must be manufactured by using a different mold, which adds additional manufacturing cost.

In addition, resistances against interferences due to nearby metal objects for the conventional antennas are less satisfactory. The interferences can adversely affect the antenna's impedance matching and its efficiency.

SUMMARY OF THE INVENTION

The instant disclosure provides a dual-band antenna and an electronic device having the same. The antenna has two feed directions for convenient assembly and a shielding wall for reducing the interference due to nearby metal objects.

The antenna has a grounding portion, a main radiating portion, and a shielding wall. The main radiating portion is connected to a first edge portion of the grounding portion. The main radiating portion has a first radiating portion and a second radiating portion arranged substantially symmetrically. The first radiating portion has a first feed end, and the second radiating portion has a second feed end. The shielding wall is connected to a second edge portion of the grounding portion and arranged across from the main radiating portion.

The first radiating portion has a first arm and a second arm arranged adjacently to each other. The second radiating portion has a third arm and a fourth arm arranged adjacently to each other. In particular, the second and fourth arms extend sideways in forming a T-shaped structure. The first and third arms extend toward each other in forming a pair of inverted L-shaped structures symmetrically. The T-shaped structure is surrounded and connected by the inverted L-shaped structures.

The instant disclosure provides another antenna having a grounding portion, a main radiating portion, and a shielding wall. The main radiating portion is connected to a first edge portion of the grounding portion. The shielding wall is connected to a second edge portion of the grounding portion and arranged across from the main radiating portion.

The aforementioned antennas can be applied in different electronic devices, such as desktop computers, multi-media players, Smart TVs, TV boxes, DVD players, etc.

In summary, the antenna of the instant disclosure has two feed ends, which allows two routing manners with the coaxial lines. The grounding portion can be adhesively secured to the electronic device, and the shielding wall protects against interferences due to nearby metal objects. In addition, the antenna structure can be manufactured with a single metal sheet through stamping and bending, which is very economical. Thus, the antenna structure can be used on electronic devices for wireless communications in providing more assembly flexibility and cost saving.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF PREFERRED EMBODIMENTS

For the descriptions below, please refer to corresponding figures. However, like or corresponding components will be referred to with like numerals throughout the several views and embodiments.

[First Embodiment]

Figure 1:
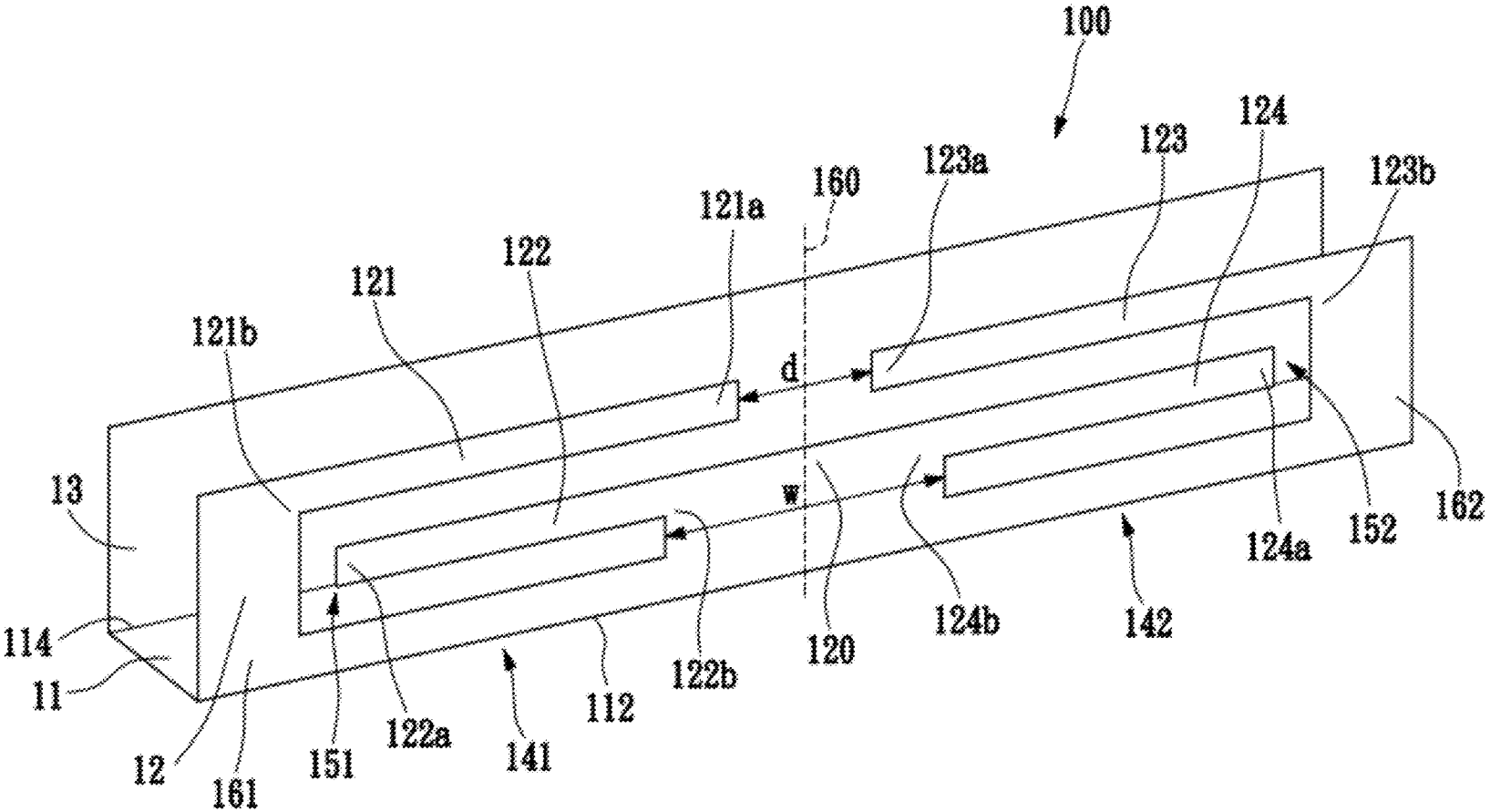
FIG. 1 is a perspective view of an antenna of a first embodiment of the instant disclosure.

FIG. 1 shows an antenna for a first embodiment of the instant disclosure. An antenna 100 comprises a grounding portion 11, a main radiating portion 12, and a shielding wall 13. The grounding portion 11 has a first edge portion 112 and a second edge portion 114. The first edge portion 112 and the second edge portion 114 may be formed in parallel, but the instant disclosure is not limited thereto. The main radiating portion 12 and the shielding wall 13 are arranged on the first edge portion 112 and the second edge portion 114, respectively. The main radiating portion 12 and the shielding wall 13 face each other by projecting in the same direction. Material wise, the grounding portion 11, the main radiating portion 12, and the shielding wall 13 can be made of metallic conductors having a variety of shapes. For example, they can have plate-like or sheet-like shape. Based on the configuration described above, these conductors can constitute the antenna 100.

Figure 2:
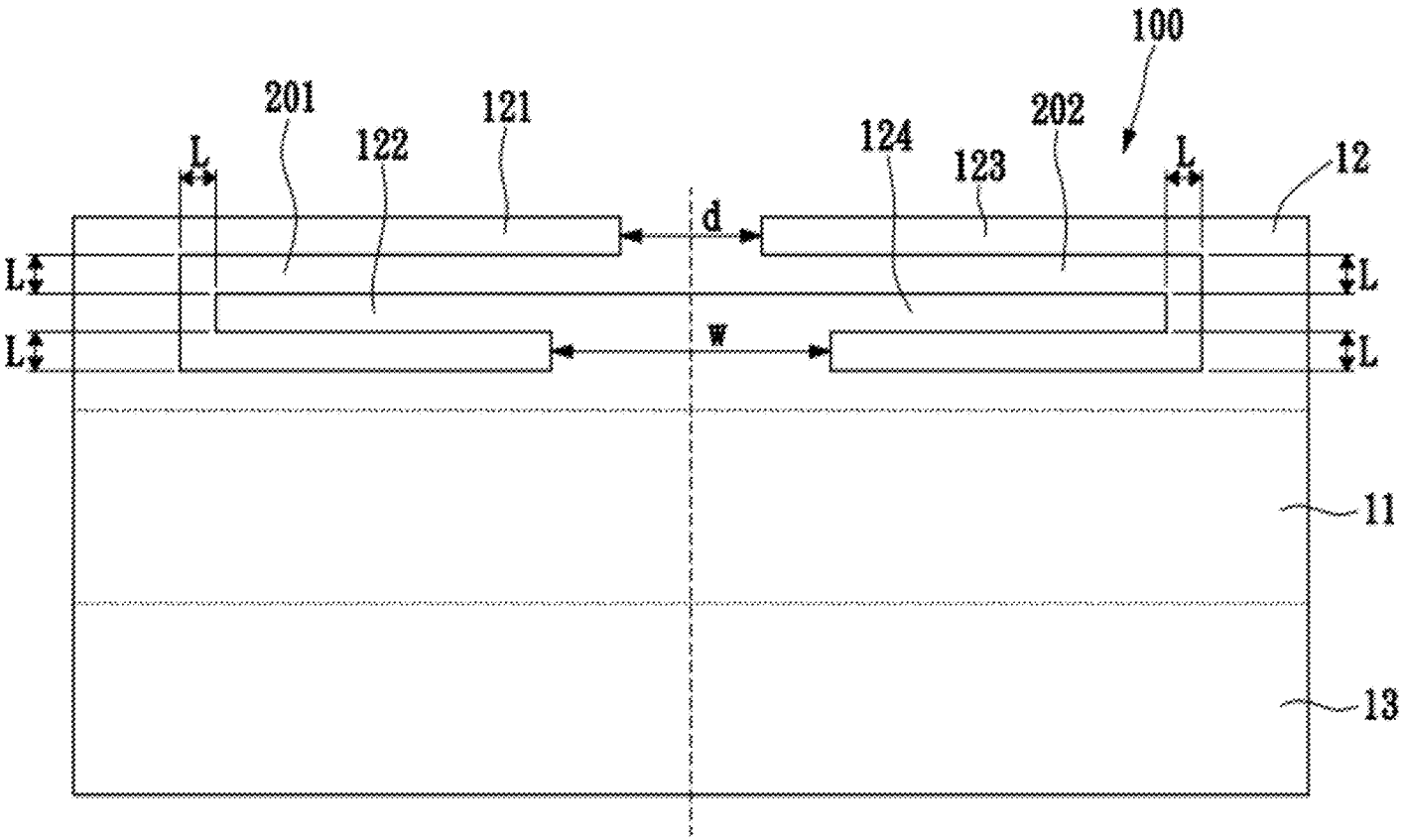
FIG. 2 is an unfolded view of the antenna of the first embodiment of the instant disclosure.

In addition to FIG. 1, please view FIG. 2, which is an unfolded view of the antenna of the first embodiment. The figures imply the antenna 100 can be formed by a single sheet-like conductor. For example, stamping process can be applied to a sheet metal in forming the main radiating portion 12. Then, the sheet metal can be bended to produce a U-shaped structure. For the U-shaped structure, the grounding portion 11 is the flat bottom piece, while the shielding wall 13 and the main radiating portion 12 form the side pieces parallelly.

For any metal objects disposed behind the shielding wall 13, its interference upon impedance matching and efficiency of the main radiating portion 12 can be reduced. Thereby, the antenna 100 can be mounted directly in front of a metal object, such as a metal frame at the top portion of a liquid crystal display (LCD). For the instant embodiment, the height of the shielding wall 13 is preferably greater than or equal to the main radiating portion 12, but is not restricted thereto. Theoretically, the larger the area of the shielding wall 13, the better is the shielding effect.

The main radiating portion 12 has a first radiating portion 141 and a second radiating portion 142 formed symmetrically. The first radiating portion 141 has a first feed end 151, and the second radiating portion 142 has a second feed end 152. The antenna signal can be fed via the first feed end 151 and/or second feed end 152. In practice, mini-coaxial cable can be used for signal transmission. Since the first and second feed ends 151 and 152 are formed in opposite directions at respective sides of the antenna 100, the mini-coaxial cable can have different routing options for connecting with the antenna 100.

Figure 3:
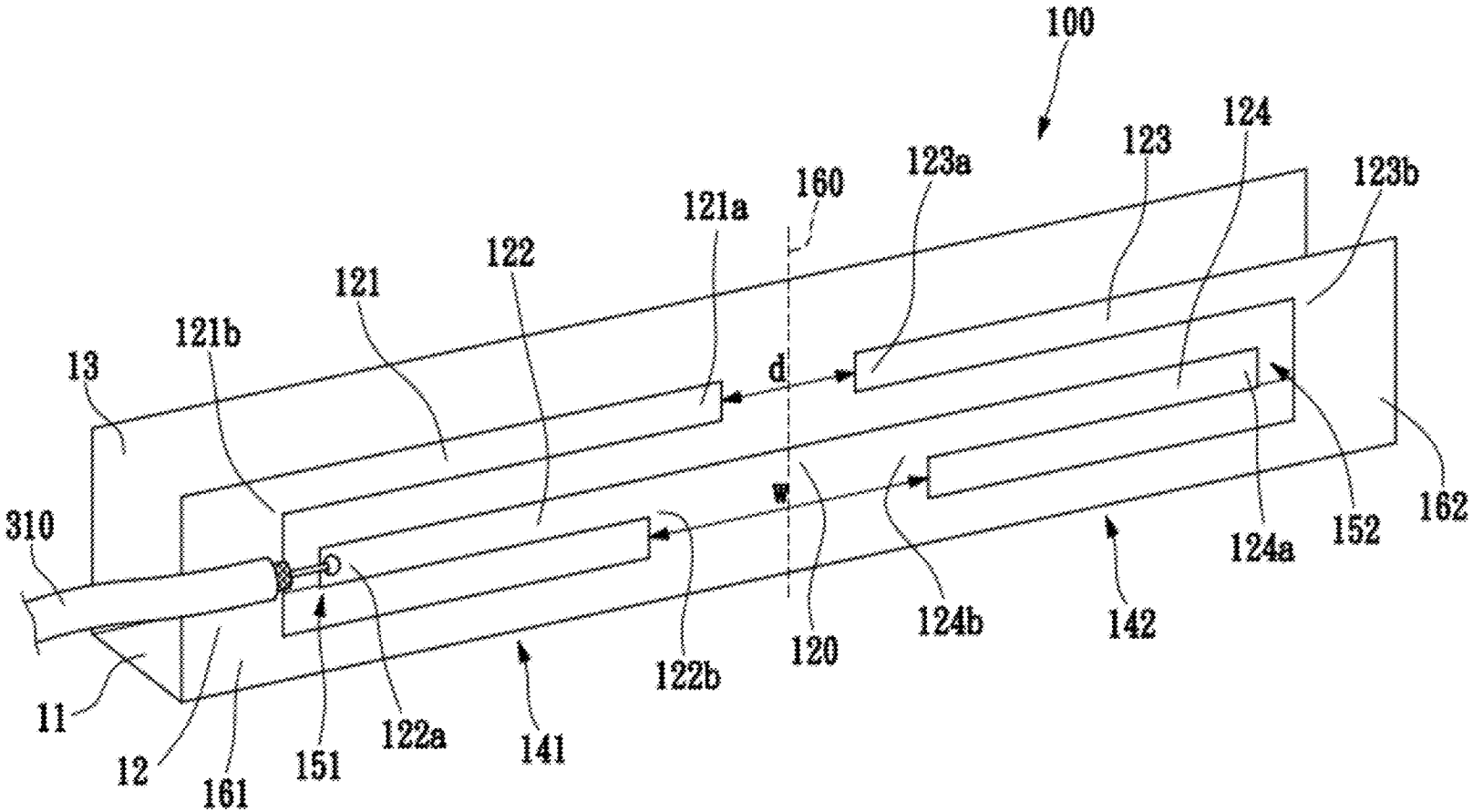
FIG. 3 is a schematic view of a mini coaxial line connected to one feed end of the antenna.
Figure 4:
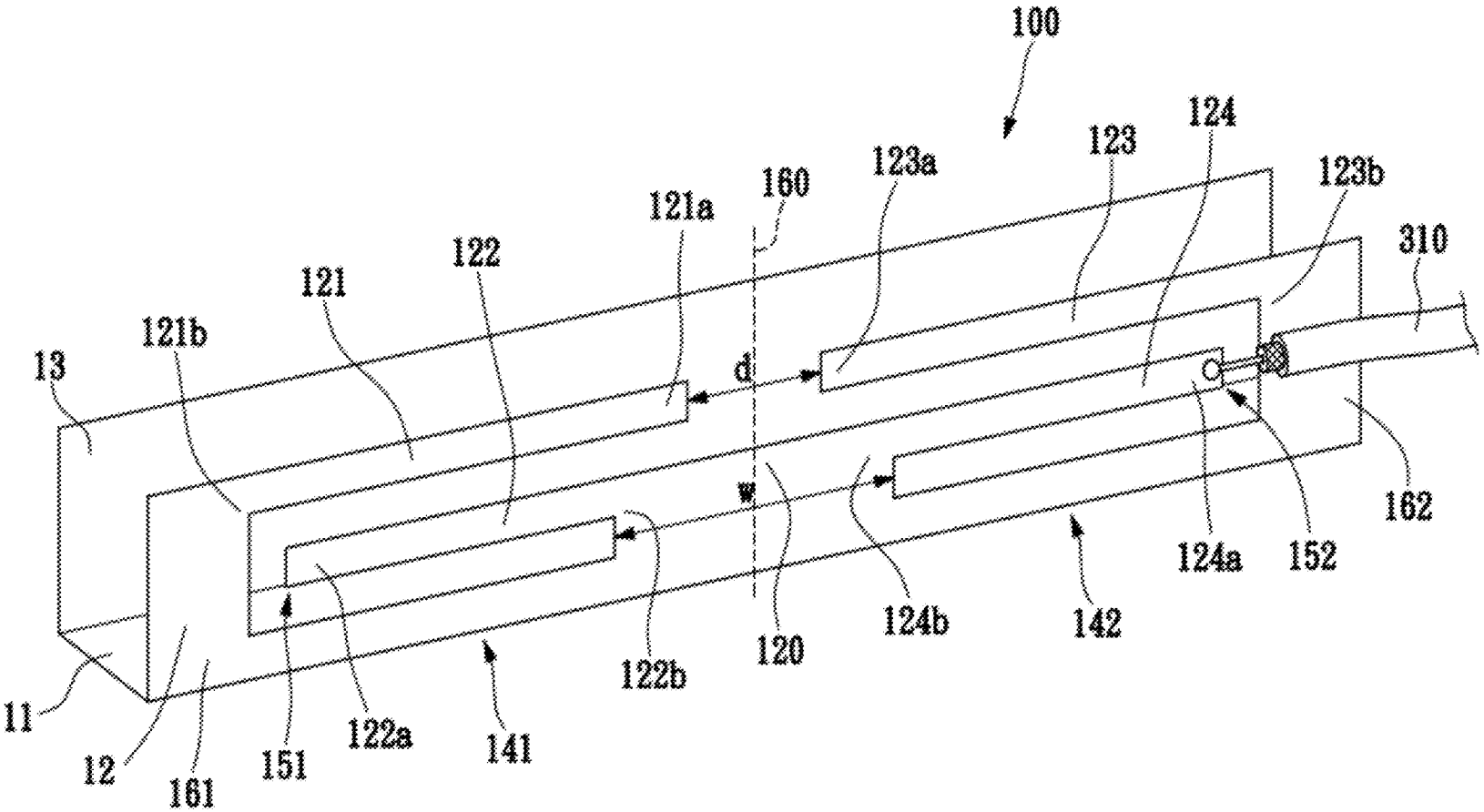
FIG. 4 is a schematic view of the mini coaxial line connected to the antenna from a different direction

The actual use of mini-coaxial cable is shown in FIGS. 3 and 4. As a feedline, the copper wire of a mini-coaxial cable 310 can be connected to the first feed end 151, and the woven copper mesh is grounded to the grounding portion 11. Alternatively, as illustrated in FIG. 4, the copper wire can be connected to the second feed end 152, with the copper mesh grounded to the grounding portion 11. Further still, antenna signal can be fed at both first feed end 151 and second feed end 152 simultaneously. Generally speaking, the feeding option is not restricted. Notably, the mini-coaxial cable 310 can be grounded to the grounding portion 11 at different locations, such as at a shorted end 121*b* of a first arm 121, or at another shorted end 123*b* of a third arm 123. The exact location is not restricted.

Please refer back to FIG. 1. The main radiating portion 12 has four arms, namely the first arm 121, a second arm 122, the third arm 123, and a fourth arm 124. The first and the second arms 121 and 122 are adjacently arranged to each other, and same setup is arranged for the third and fourth arms 123 and 124. The second arm 122 and the fourth arm 124 extend sideways from the central portion of the main radiating portion 12 in forming a T-shaped structure 120. The first arm 121 and the third arm 123 extend toward each other from opposite side portions of the main radiating portion 12 in forming an inverted L-shaped structure 161 and 162, respectively. The T-shaped structure 120 is surrounded by the inverted L-shaped structures 161 and 162.

Please refer back to FIG. 2. For the instant embodiment, the clearances between various arms are denoted by the symbol L. Preferably, L is less than or equal to 2 mm. Namely, the clearance between the first feed end 151 and the inverted L-shaped structure 161 is preferably less than or equal to 2 mm, and the same goes for the second feed end 152 and the inverted L-shaped structure 162. However, the clearance distance is not restricted.

A looped first gap 201 which is defined by the space formed between the first arm 121 and the second arm 122 extends to the base portion of the main radiating portion 12 near the grounding portion 11. Likewise, a looped second gap 202 which is defined by the space between the third arm 123 and the fourth arm 124 extends to base portion of the main radiating portion 12 near the grounding portion 11. For the instant embodiment, the first gap 201 and the second gap 202 are symmetrical to each other and have approximately the same width. The width is preferably less than or equal to 2 mm, which is L, but is not restricted thereto.

The central portion of the T-shaped structure 120 is referred to as the neck portion, which is connected to the grounding portion 11. The second arm 122 has a shorted end 122*b* formed thereon, which is connected to the neck portion of the T-shaped structure 120. The second arm 122 also has an open end 122*a* formed thereon extended toward the shorted end 121*b* of the first arm 121 in forming the first feed end 151. Symmetrically, the fourth arm 124 has a shorted end 124*b* formed thereon connected to the neck portion of the T-shaped structure 120. The fourth arm 124 also has an open end 124*a* formed thereon extended toward the shorted end 123*b* of the third arm 123 in forming the second feed end 152.

A dotted dividing line 160 separates the antenna 100 into two symmetrical radiating portions, namely, the first radiating portion 141 and the second radiating portion 142. Structurally, the first radiating portion 141 and the second radiating portion 142 are formed by the inverted L-shaped structures 161 and 162, respectively. From another perspective, the T-shaped structure 120 can be viewed as the product of two inverted L-shaped structures. Since those skilled in the art can perceive such concept from FIG. 1, no further descriptions are given herein.

Figure 5:
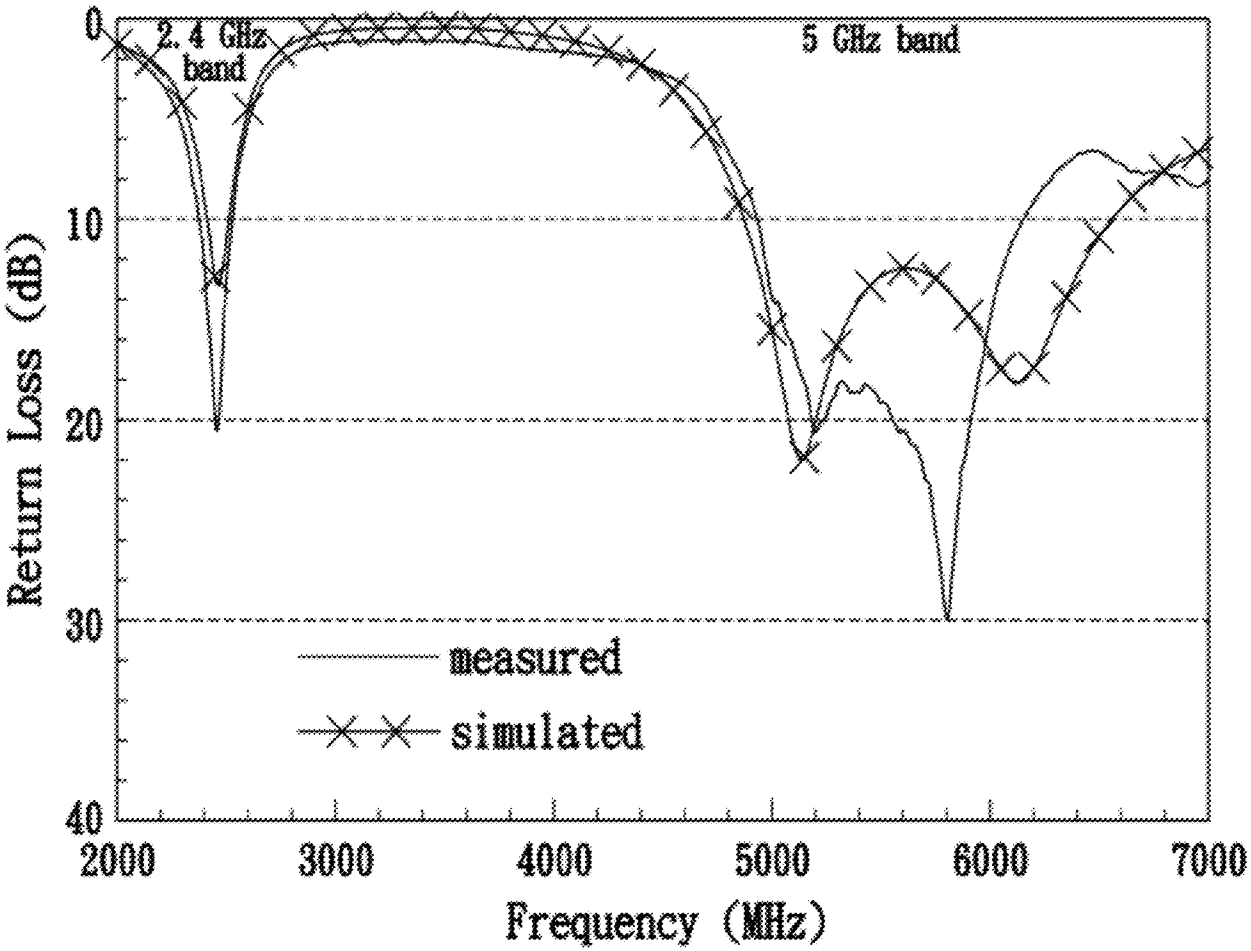
FIG. 5 is a plot showing the return loss versus frequency for the antenna of the instant disclosure.

The antenna 100 of the instant embodiment has multiple resonance modes with different operating bands. Please refer to FIG. 5, which shows the return loss of the antenna 100 for different operating bands. The plot shows both measured and simulated results. The plot suggests the antenna 100 has three frequency bands of 2.4 GHz, 5.2 GHz, and 5.8 GHz. The return losses of all three frequency bands are greater than 10 dB. In particular, the return losses for the 5.2 GHz and 5.8 GHz bands are greater than 14 dB. Notice that the Japanese 5 GHz (4.9~5.0 GHz) band is also included.

Figure 6:
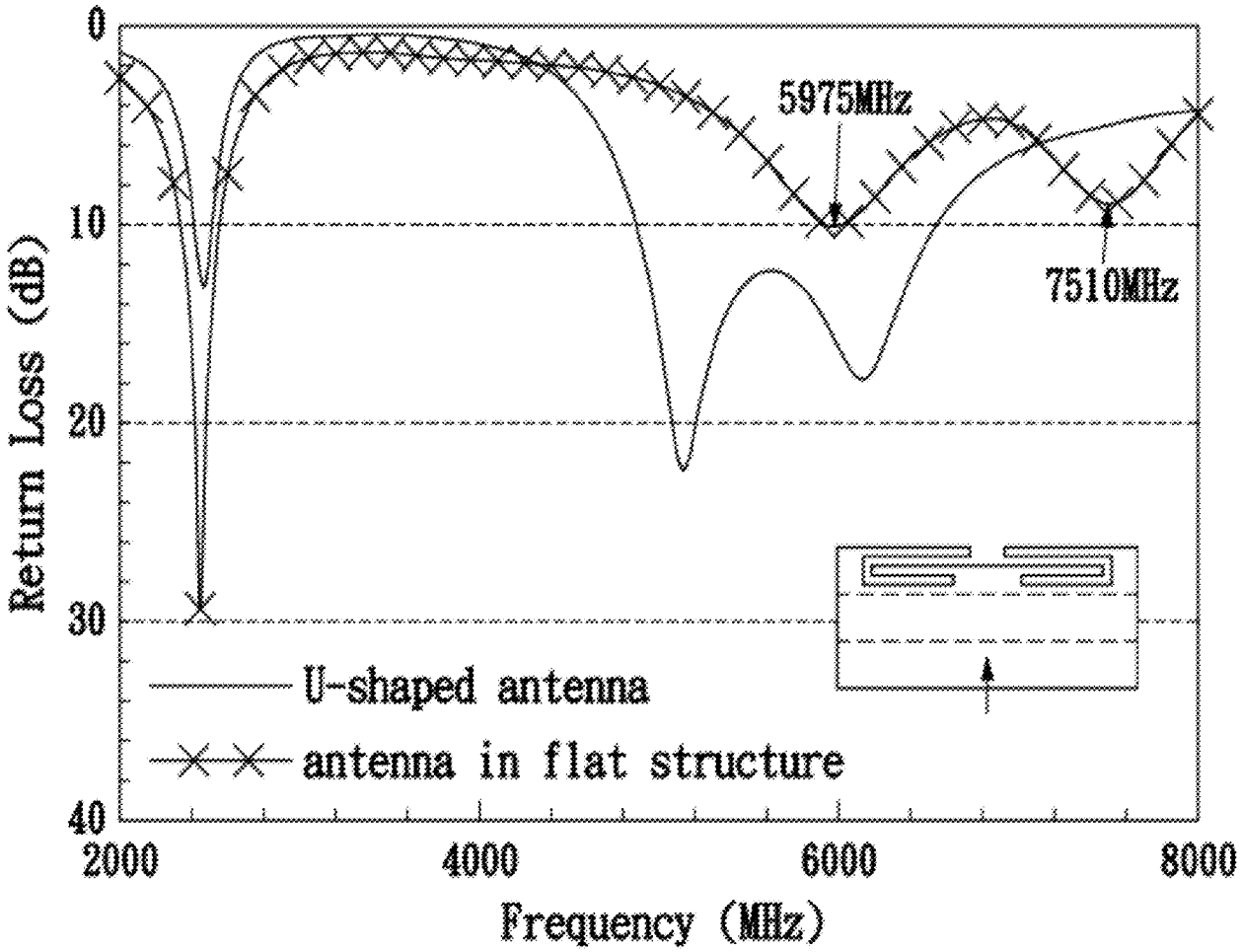
FIG. 6 is a plot comparing the return loss versus frequency between the U-shaped antenna and the planar antenna of the instant disclosure.

Notably, the antenna 100 of the instant embodiment can also be designed as a flat structure without any bend. As shown in FIG. 6, such antenna has two operating bands (i.e., 5975 MHz and 7510 MHz) with return losses of equal to or less than 10 dB. However, at the 2.4 GHz band, the flat antenna exhibits a better return loss of greater than 25 dB.

Figures 7A, 7B, 7C:
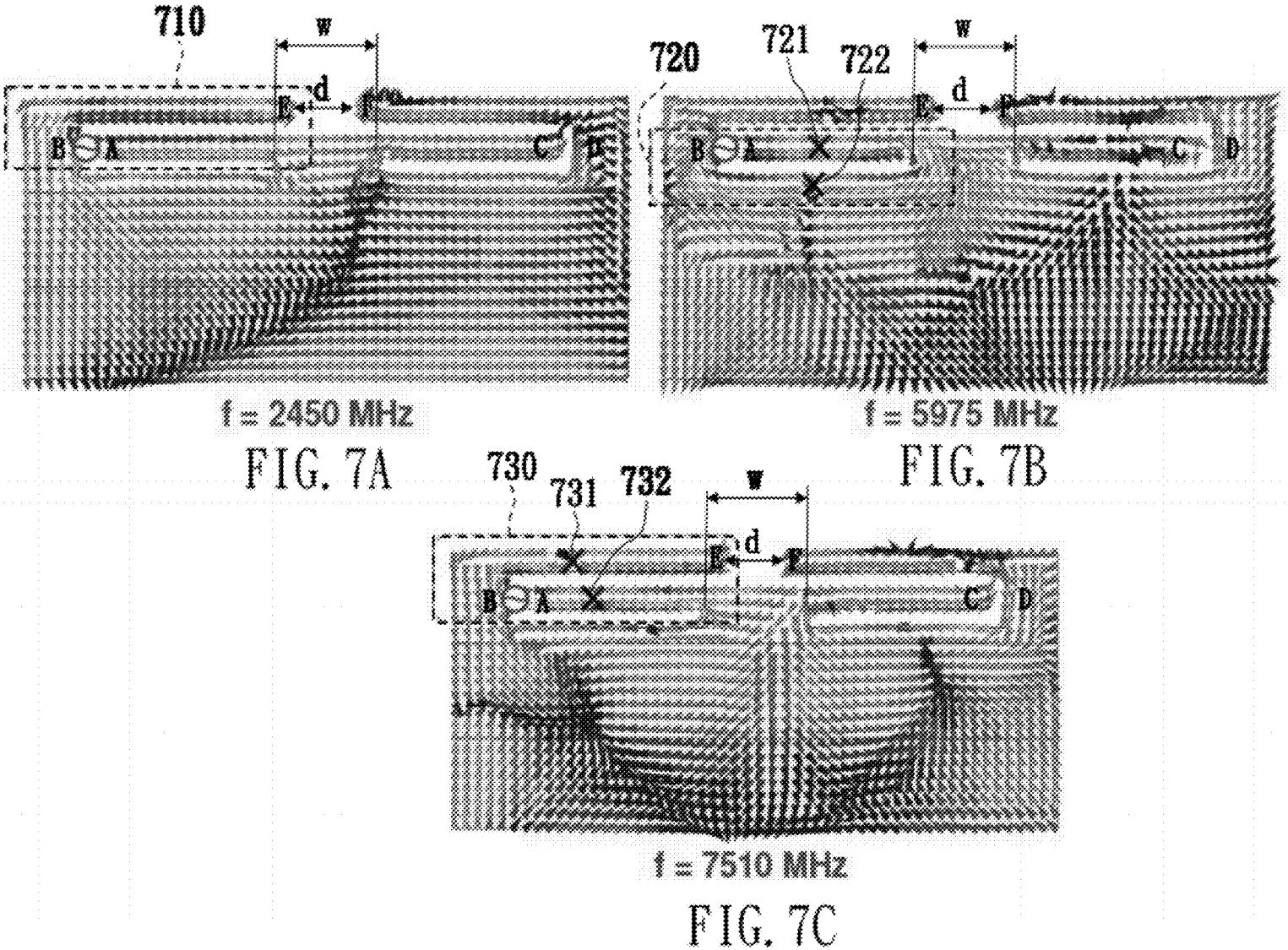
FIGS. 7A~7C show the current distributions for the antenna of the instant disclosure at three different frequency bands.

The antenna 100 has different surface current paths for various resonance modes, as shown in FIGS. 7A~7C. The currents are plotted in the vector form (in an arrow shape) to identify the current nulls (denoted as crosses in the figures). The thicker the arrow is, the stronger the current is. The figures show the surface current distributions for the corresponding frequency bands. In FIG. 7A, the signal source is located between the end points A and B, which suggests the antenna signal is fed through the first feed end 151. FIG. 7A shows the surface current path and direction at a frequency of 2450 MHz. FIGS. 7B and 7C are for a frequency of 5975 MHz and 7510 MHz, respectively. Indicated by the region 710 in FIG. 7A, the current path at 2450 MHz mainly surrounds the first and second arms 121 and 122. The antenna with such current path is identified as a half-wavelength loop, which is used to excite the resonance mode having a 2450 MHz band. This current path also contributes toward the resonance mode of 7510 MHz.

As evident in FIG. 7B, the current path that excites the 5975 MHz band mainly surrounds the second arm 122 and the area underneath it. As indicated by the region 720, the current null locations are marked by the labels 721 and 722. The antenna with such current path is identified as a one-wavelength loop, which is used to excite the resonant mode having a 5975 MHz band. In FIG. 7C, the current path that excites the 7510 MHz band mainly surrounds the first and second arms 121 and 122. The labels 731 and 732 marked the locations of current nulls. As shown in region 730, the current nulls are located at the middle portion of the first and second arms 121 and 122. The antenna with such current path is identified as a one-wavelength loop mode to excite the resonant mode having a 7510 MHz band.

FIGS. 7A~7C show that the current path for the lowest resonant mode is from point A to point C, and from point D to point B via point E and F. The current path for higher resonant mode is symmetrical. The main differences between various resonant modes have to do with different current paths.

Figure 8:
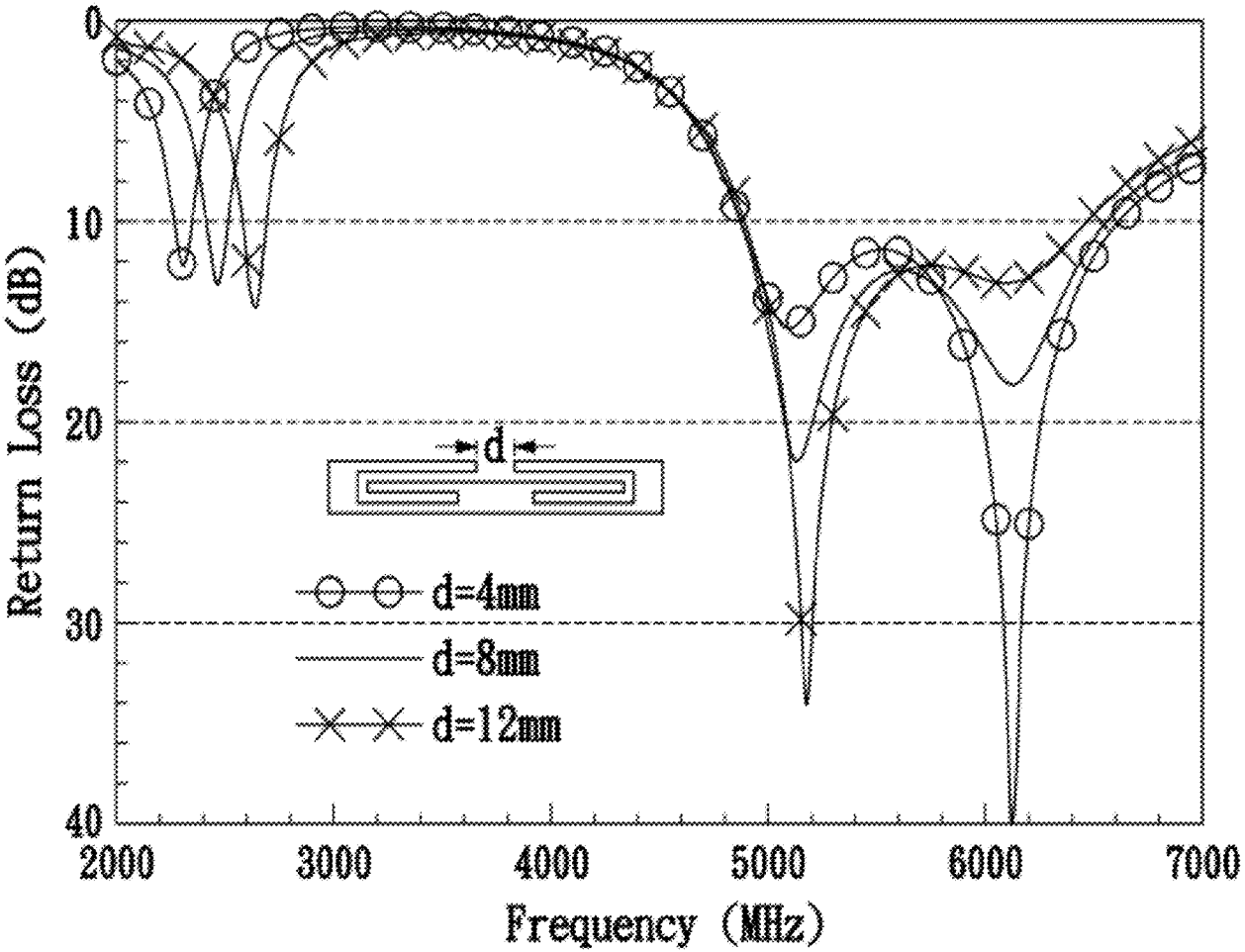
FIG. 8 is a plot showing the return loss having a connection with a distance d for the antenna of the instant disclosure.
Figure 9:
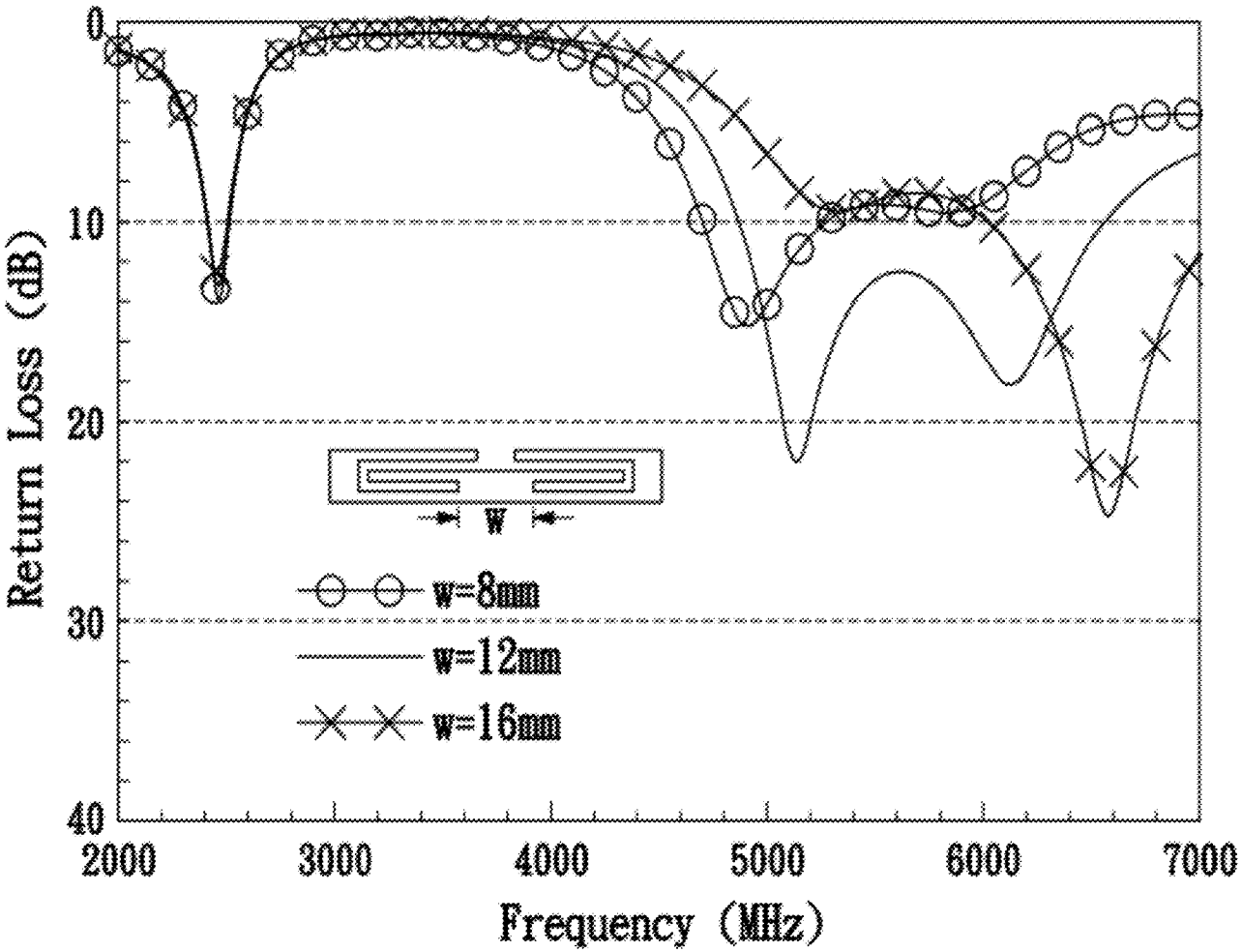
FIG. 9 is a plot showing the return loss having a connection with a width w for the antenna of the instant disclosure.

Also, FIGS. 7A~7C imply the operating bands of the antenna 100 depends on a distance d between point E and F and a width w for the neck portion of the T-shaped structure 120. Please refer to FIG. 8, which shows the return loss having a connection with the distance d. For explaining purposes only, the width of the grounding portion 11, the main radiating portion 12, and the shielding wall 13 is chosen to be 10 mm, and the length of each aforementioned element is 70 mm. The actual width and length are not restricted. Simulation results are compared for the distance d equals to 4 mm, 8 mm, and 12 mm. The distance d is defined as the clearance between an open end 121*a* of the first arm 121 and an open end 123*a* of the third arm 123. The operating frequencies of the lower resonance, such as 2.4 GHz, are largely affected by the distance d, while those for the upper resonance are about the same. When d increases, the half-wavelength loop becomes smaller, such that the resonance frequency of 2.4 GHz is shifted to higher frequencies. Please refer to FIG. 9, which shows the return loss having a connection with the width w. Simulation results are compared for the width w equals to 8 mm, 12 mm, and 16 mm. Unlike d, the operating frequencies of the higher resonance, such as 5.0 GHz, are largely affected by the width w, while those for the lower resonance are about the same. As w increases, the upper resonance frequencies are shifted higher.

Figure 10:
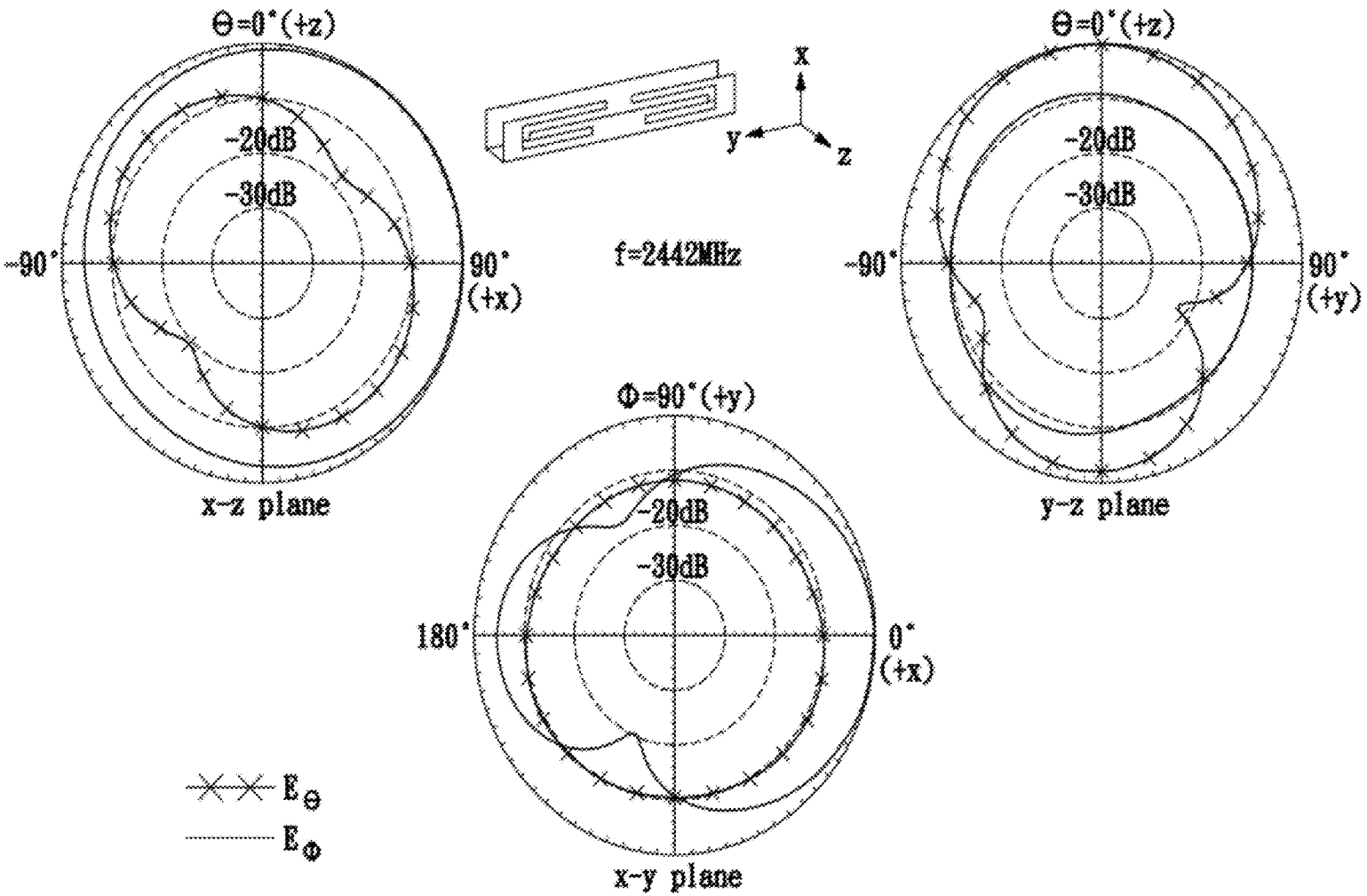
FIGS. 10~12 show radiation patterns for the antenna of the first embodiment of the instant disclosure at a frequency of 2442 MHz, 5250 MHz, and 5775 MHz, respectively.
Figure 11:
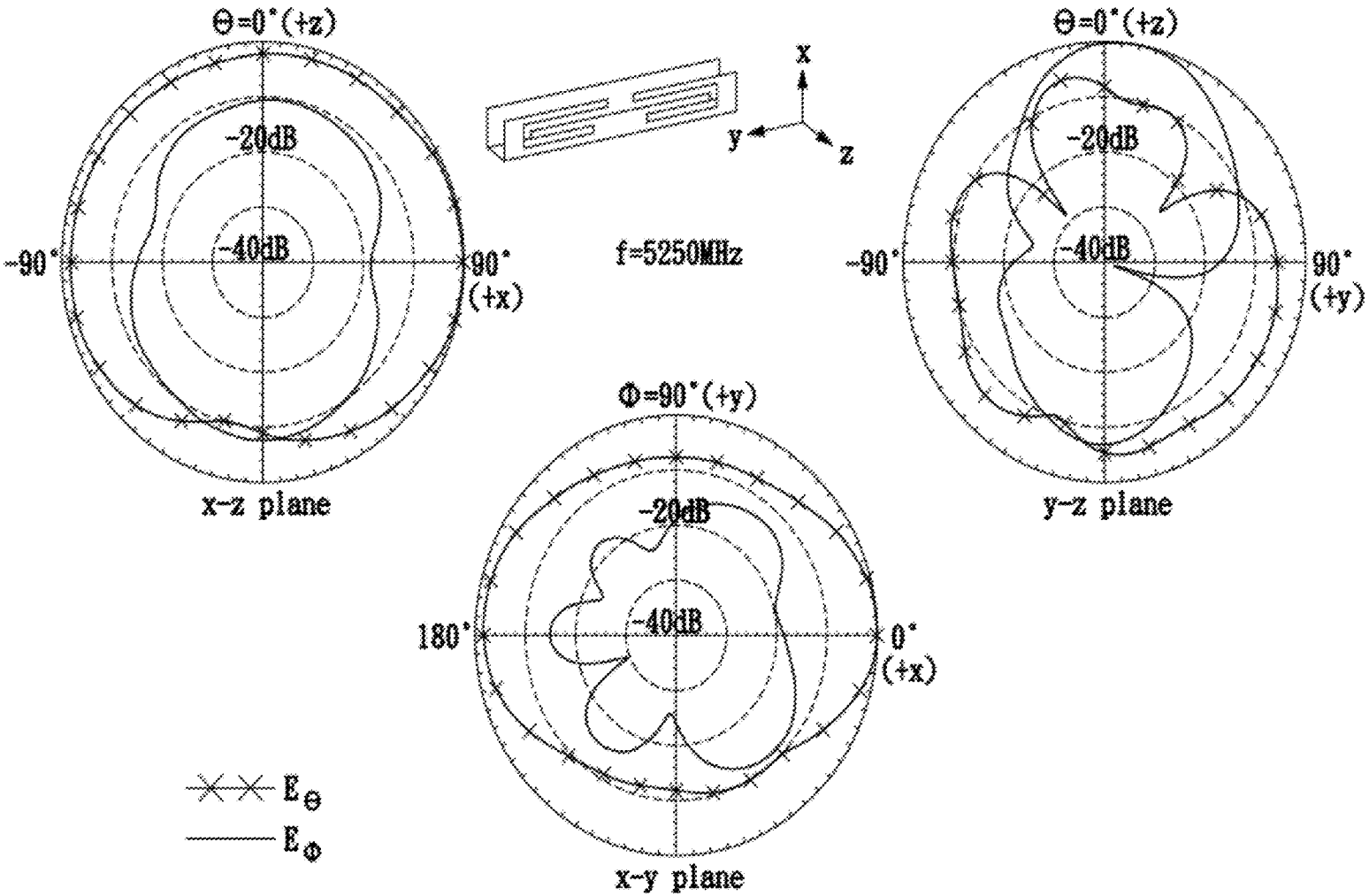
Figure 12:
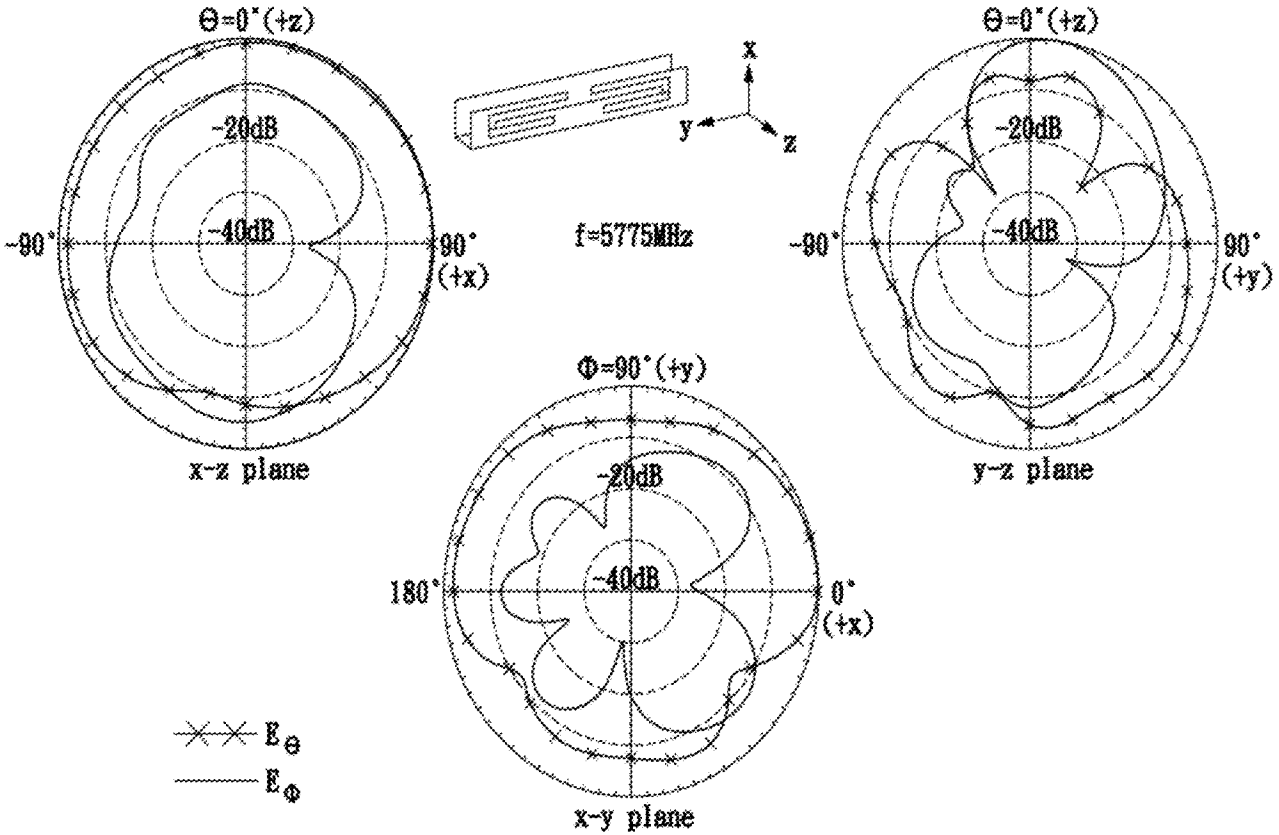

The performance of the antenna in free space is also studied. FIGS. 10~12 show the radiation patterns for the antenna 100 at operating frequencies of 2442 MHz, 5250 MHz, and 5775 MHz. The figures show the antenna is near omnidirectional in radiating power uniformly in the x-z plane. In use, when the antenna 100 is arranged onto the metal frame of an electronic device, such as a LCD TV, the x-z plane is perpendicular to the antenna 100. Thus, the antenna can have better signal reception particularly in the x-z plane. Notably, due to the shielding wall 13, the antenna 100 has strongest radiating power in the z direction.

Figure 13:
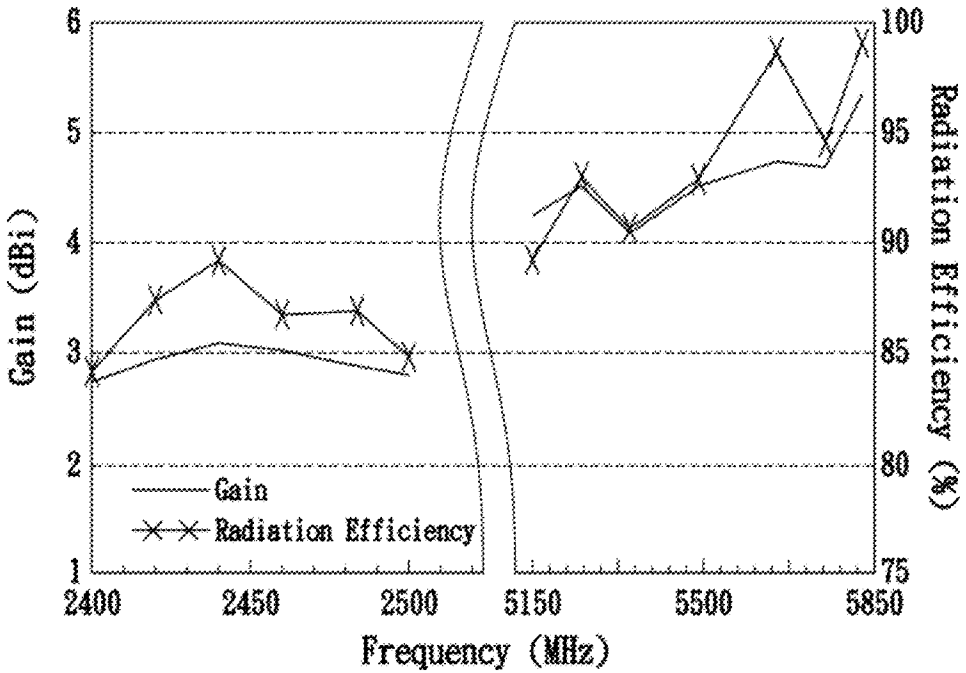
FIG. 13 is a plot showing the power gain and radiation efficiency for the antenna of the first embodiment of the instant disclosure.

Please refer to FIG. 13, which gives the measured peak antenna gain and the radiation efficiency against frequency. The peak gain in the 2.4 GHz band is at a constant level of about 2.9 dBi with radiation efficiency larger than 84%. For the 5.2 GHz and 5.8 GHz bands, the gain varies from 4.1 dBi to 5.3 dBi with the radiation efficiency exceeding 86%. The radiation efficiency can be obtained by calculating the total radiated power of the antenna under test (AUT) by giving an input power of 0 dBm (default value) to the AUT in the test lab. The radiation efficiency can be expressed as the ratio between the antenna's input power and its radiated power, in yielding a value between 0.0 and 1.0. Based on above discussions, calculation and simulation details can be inferred by someone who is skilled in the art, hence no additional details are given herein.

Figure 14:
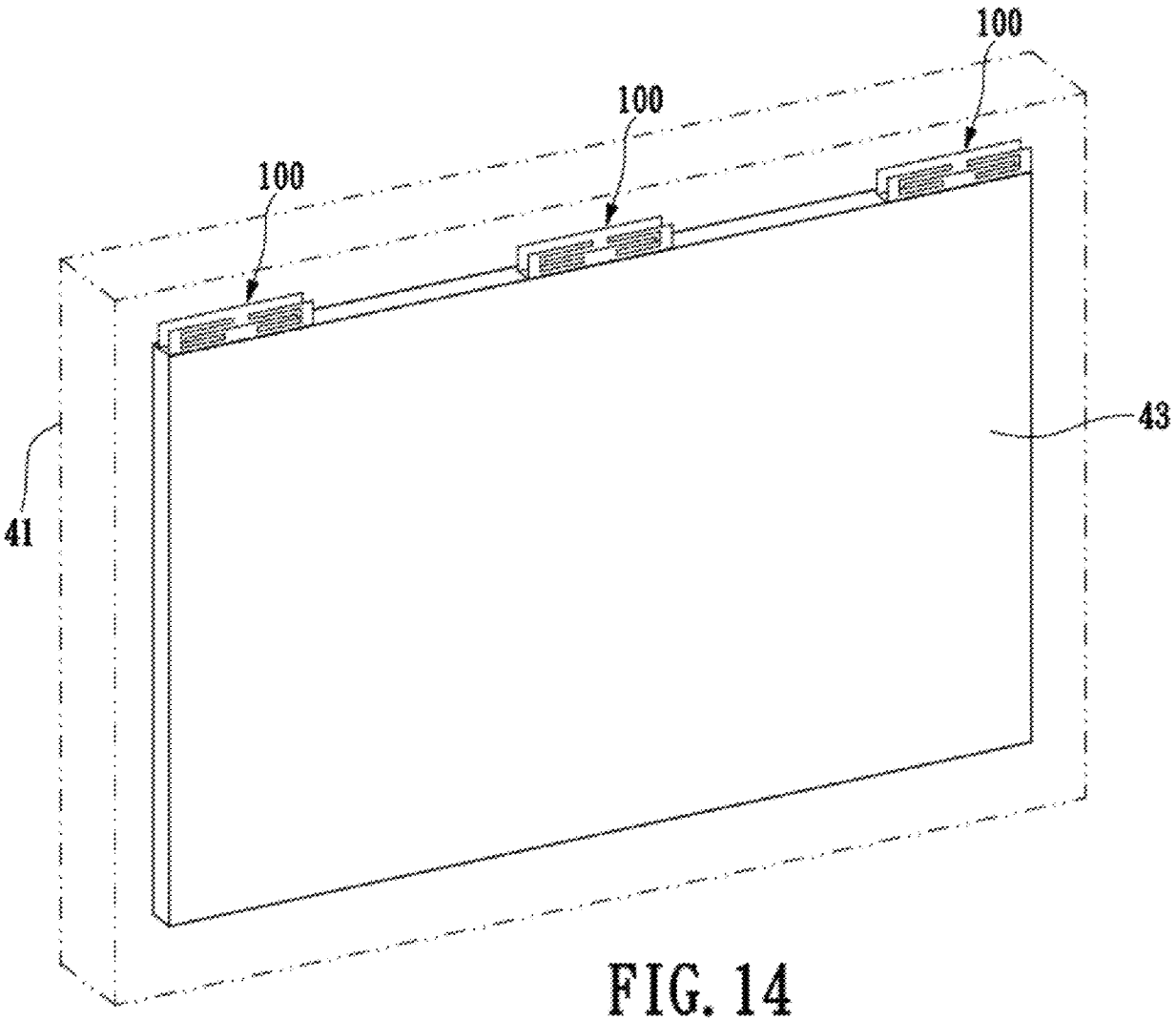
FIG. 14 is a schematic view showing the antenna being used with an electronic device.

When mounting the antenna 100, the grounding portion 11 can be adhesively secured to the top portion of the LCD TV. The backside of the shielding wall 13 may face toward the metal frame of the LCD TV. The shielding wall 13 can reduce interference from the metal frame over impedance matching and radiation patterns of the antenna 100. Therefore, the antenna can have better radiation performance. Please refer to FIG. 14, which shows the antenna 100 in use. The antennas 100 can be mounted onto the top surface of a display 43 of the LCD TV and laid against a metal frame 41. Since each antenna 100 can receive the signal from two different locations thereon, the capability allows more wiring flexibility and options.

[Second Embodiment]

Figure 15:
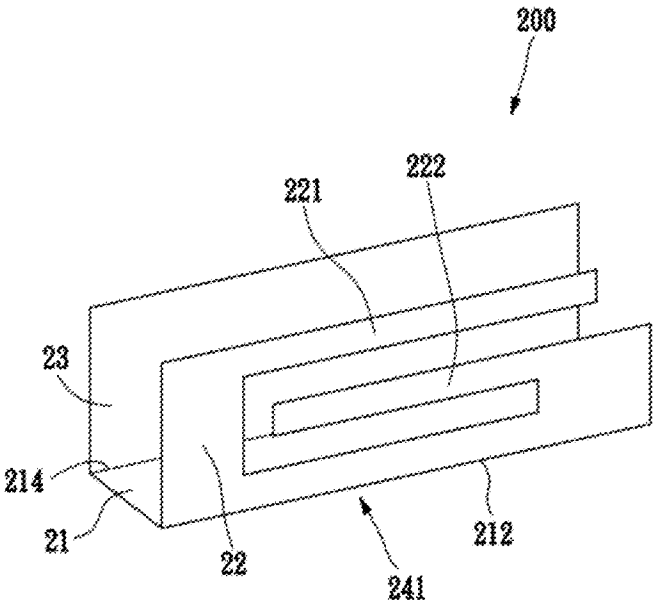
FIG. 15 shows an antenna for a second embodiment of the instant disclosure.

The abovementioned antenna 100 of the first embodiment is formed with the first sub-radiating portion 141 and the second sub-radiating portion 142 symmetrically. For a second embodiment, the antenna can be configured in only having half of the first embodiment, as shown in FIG. 15. Based on the imaginary dividing line 160 for the antenna 100 in FIG. 1, the antenna 100 of the first embodiment can be divided into a left portion and a right portion. The standalone left portion gives an antenna 200 for the second embodiment. The antenna 200 only has a first radiating portion 241. The antenna 200 has a grounding portion 21, a main radiating portion 22, and a shielding wall 23. The grounding portion 21 has a first edge portion 212 and a second edge portion 214 running lengthwise parallelly. The main radiating portion 22 and the shielding wall 23 are connected to the first side portion 212 and the second side portion 214 of the grounding portion 21, respectively. The shielding wall 23 and the main radiating portion 22 faces each other and extend in the same direction. The main radiating portion 22 has only a first arm 221 and a second arm 222. Other details of the antenna 200 can be inferred from previous discussions of the antenna 100, therefore are not repeated herein.

Figure 16:
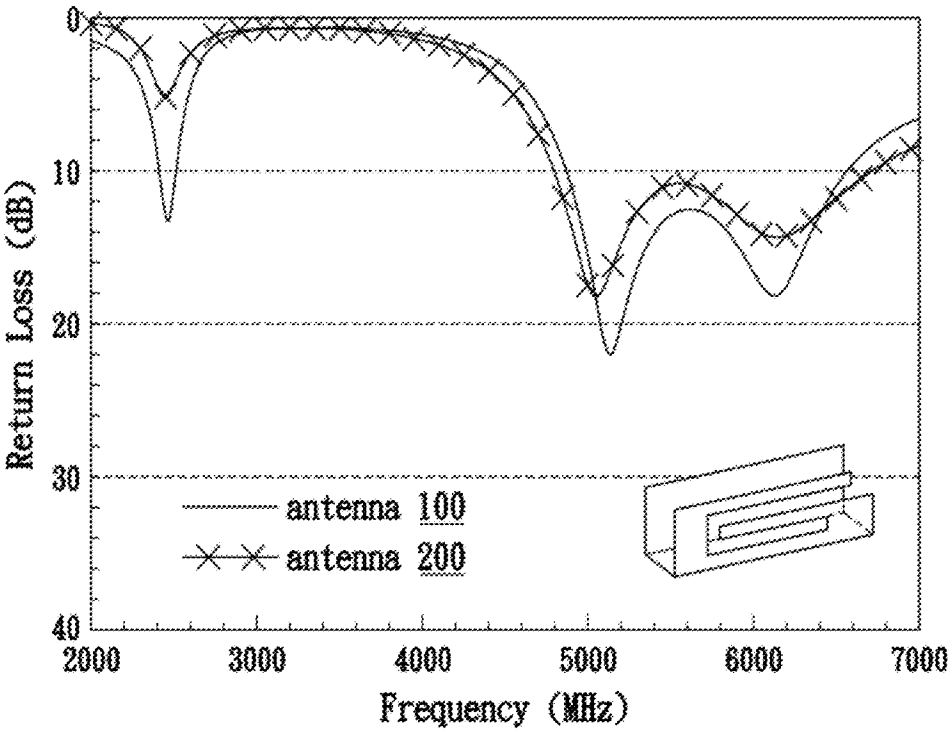
FIG. 16 is a plot comparing the return loss between the antenna of the first embodiment and the second embodiment of the instant disclosure.

Please refer to FIG. 16, which compares the return loss between the antennas 100 and 200 at various frequencies. For lower operating frequencies, the return losses for the antenna 200 are worse. However, at 5 GHz band, the return loss for the antenna 200 is greater than 10 db, just like the antenna 100. Therefore, by cutting the antenna 100 in half, the half structure can be used as an antenna by itself, and particularly applicable for the 5 GHz band. The user may use either antenna based on needs without any restriction.

[Third Embodiment]

Figure 17B:
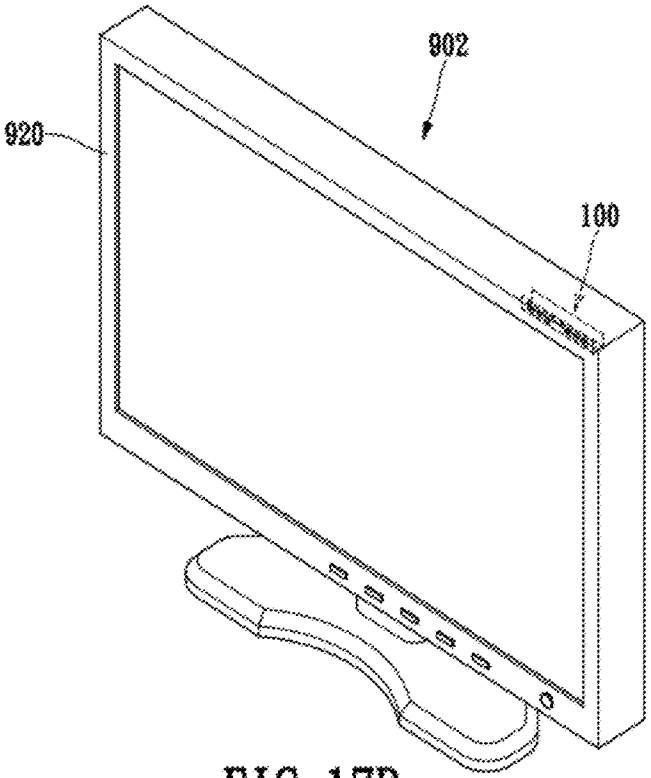
FIGS. 17*a* and 17*b* are schematic views showing electronic devices for the third embodiment of the instant disclosure.
Figure 17A:
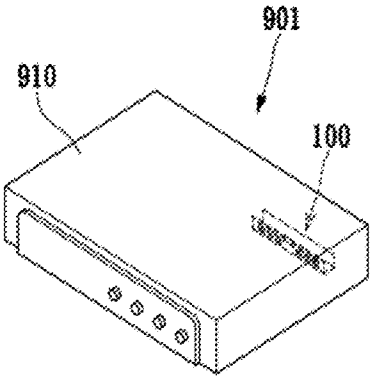

The antennas 100 and 200 of the instant disclosure can be used with a variety of electronic devices, such as multi-media players, Smart TVs, TV boxes, desktop computers, DVD players, etc. Please refer to FIGS. 17A and 17B, which show different electronic devices for a third embodiment of the instant disclosure. In FIG. 17A, an electronic device 901 comprises a host computer 910 and the antenna 100. The host computer 910 can be connected to the antenna 100 through its first feed end 151 or second feed end 152. Through the antenna 100, the host computer 910 may perform wireless data transmission with other electric devices, for example through the internet. The electronic device 901 may be the host computer for a multi-media player, a TV box, a DVD player, or a desktop computer. In FIG. 17B, the electronic device 902 is a Smart TV. The antenna 100 is installed within a mainframe 920 for wireless data transmission.

Notably, the antenna 100 used in FIGS. 17A and 17 B can be replaced by the antenna 200. Based on preceding discussions, the use of antenna 200 can be easily inferred by a person who is skilled in the art, therefore is not repeated herein.

In summary, the multi-band antenna of the instant disclosure has symmetrical radiating portions and the shielding wall. The shielding wall reduces interference from metal objects behind the wall. Therefore, the antenna can have better radiation patterns and matching impedance. At 2.4 GHz band, the antenna's peak gain is 2.9 dBi with the radiation efficiency of 84%. At 5 GHz band, the peak gain is 4.7 dBi, and the radiation efficiency is 89%. Having such characteristics, the antenna of the instant disclosure provides an improved alternative for built-in antennas in electronic devices.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An antenna, comprising:

a grounding portion having a first edge portion and a second edge portion;

a main radiating portion arranged on the first edge portion of the grounding portion, the main radiating portion having a first radiating portion and a second radiating portion formed substantially symmetrically, the first radiating portion having a first feed end, the second radiating portion having a second feed end; and a shielding wall arranged on the second edge portion of the grounding portion across from the main radiating portion;

wherein a T-shaped structure is formed in the middle of the main radiating portion, wherein the first feed end and the second feed end are formed in opposite directions at respective sides of the T-shaped structure;

wherein a first signal transmission cable is connected to the first feed end for feeding a first antenna signal, and a second signal transmission cable is connected to the second feed end for feeding a second antenna signal;

wherein the first radiating portion has a first arm and a second arm, and the first arm and the second arm are arranged adjacently, wherein the second radiating portion has a third arm and a fourth arm, and the third arm and the fourth arm are arranged adjacently, wherein the second arm and the fourth arm extend sideways from a central portion of the main radiating portion to form the T-shaped structure, wherein the first arm and the third arm extend from the side portions of the main radiating portion toward the central portion thereof in forming a pair of opposing inverted L-shaped structures, the T-shaped structure being surrounded by the inverted L-shaped structures.

2. The antenna of claim 1, wherein the T-shaped structure has a neck portion connected to the grounding portion, the second arm having a second shorted end and a second open end formed thereon, the first arm having a first shorted end formed thereon, the second shorted end being connected to the neck portion of the T-shaped structure, wherein the second open end extends toward the first shorted end of the first arm in forming the first feed end, the fourth arm having a fourth shorted end and a fourth open end formed thereon, the third arm having a third shorted end formed thereon, the fourth shorted end being connected to the neck portion of the T-shaped structure, the fourth open end extending toward the third shorted end of the third arm in forming the second feed end.

3. The antenna of claim 1, wherein the first arm having a first open end and the third arm having a third open end, wherein a pre-determined distance is formed between the first open end and the third open end, and wherein the operating bandwidth of the antenna has a connection with the pre-determined distance and the width of the neck portion of the T-shaped structure.

4. The antenna of claim 1, wherein a first gap is formed between the first arm and the second arm, wherein a second gap is formed between the third arm and the fourth arm, and wherein the first gap and the second gap have substantially the same width.

5. The antenna of claim 1, wherein the height of the shielding wall is greater than or equal to the height of the main radiating portion.

6. The antenna of claim 1, wherein the grounding portion, the main radiating portion and the shielding wall are formed by a single sheet metal through a stamping process.

7. An electronic device, comprising:

a host computer; and an antenna arranged within the host computer, comprising:

a grounding portion having a first edge portion and a second edge portion;

a main radiating portion arranged on the first edge portion of the grounding portion, the main radiating portion having a first radiating portion and a second radiating portion formed substantially symmetrically, the first radiating portion having a first feed end, the second radiating portion having a second feed end; and a shielding wall arranged on the second edge portion of the grounding portion across from the main radiating portion;

wherein a T-shaped structure is formed in the middle of the main radiating portion, wherein the first feed end and the second feed end are formed in opposite directions at respective sides of the T-shaped structure;

wherein a first signal transmission cable is connected to the first feed end for feeding a first antenna signal, and a second signal transmission cable is connected to the second feed end for feeding a second antenna signal;

wherein the host computer is connected to the antenna through the first feed end or the second feed end of the main radiating portion for wireless data transmission;

wherein the first radiating portion has a first arm and a second arm, wherein the second radiating portion has a third arm and a fourth arm, the first arm and the second arm being arranged adjacently, the third arm and the fourth arm being arranged adjacently, wherein the second arm and the fourth arm extend sideways from a central portion of the main radiating portion to form the T-shaped structure, wherein the first arm and the third arm extend from the side portions of the main radiating portion toward the central portion thereof in forming a pair of opposing inverted L-shaped structures, the T-shaped structure being surrounded by the inverted L-shaped structures.

8. The electronic device of claim 7, wherein the T-shaped structure has a neck portion connected to the grounding portion, the second arm having a second shorted end and a second open end formed thereon, the first arm having a first shorted end formed thereon, the second shorted end being connected to the neck portion of the T-shaped structure, wherein the second open end extends toward the first shorted end of the first arm in forming the first feed end, the fourth arm having a fourth shorted end and a fourth open end formed thereon, the third arm having a third shorted end formed thereon, the fourth shorted end being connected to the neck portion of the T-shaped structure, the fourth open end extending toward the third shorted end of the third arm in forming the second feed end.

9. The electronic device of claim 7, wherein the first arm having a first open end and the third arm having a third open end, wherein a pre-determined distance is formed between the first open end and the third open end, and wherein the operating bandwidth of the antenna has a connection with the pre-determined distance and the width of the neck portion of the T-shaped structure.

10. The electronic device of claim 7, wherein a first gap is formed between the first arm and the second arm, wherein a second gap is formed between the third arm and the fourth arm, and wherein the first gap and the second gap have substantially the same width.

11. The electronic device of claim 7, wherein the height of the shielding wall is greater than or equal to the height of the main radiating portion.

12. The electronic device of claim 7, wherein the grounding portion, the main radiating portion and the shielding wall are formed by a single sheet metal through a stamping process.

13. The electronic device of claim 7, wherein the electronic device is a multi-media player, a Smart TV, a TV box, a desktop computer or a DVD player.

* * * * *